US007925190B2

(12) United States Patent
Matsumoto et al.

(10) Patent No.: US 7,925,190 B2
(45) Date of Patent: Apr. 12, 2011

(54) DEVELOPER SUPPLY DEVICE AND IMAGE FORMING APPARATUS COMPRISING SAME

(75) Inventors: Keiko Matsumoto, Kanagawa (JP); Mugijirou Uno, Kanagawa (JP); Hiroyuki Okaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 844 days.

(21) Appl. No.: 11/756,194

(22) Filed: May 31, 2007

(65) Prior Publication Data

US 2007/0280742 A1 Dec. 6, 2007

(30) Foreign Application Priority Data

Jun. 2, 2006 (JP) ..... 2006-155106

(51) Int. Cl.
*G03G 15/08* (2006.01)
*G03G 9/00* (2006.01)

(52) U.S. Cl. ..... 399/258; 399/262; 430/110.4

(58) Field of Classification Search ..... 399/258; 430/123

See application file for complete search history.

(56) References Cited

U.S. PATENT DOCUMENTS

| | | | |
|---|---|---|---|
| 6,022,660 | A | 2/2000 | Uno |
| 6,074,795 | A | 6/2000 | Watanabe et al. |
| 6,103,441 | A | 8/2000 | Tomita et al. |
| 6,180,298 | B1 | 1/2001 | Kuroda et al. |
| 6,363,229 | B1 | 3/2002 | Shiraishi et al. |
| 6,512,901 | B2 | 1/2003 | Uno |
| 6,566,026 | B2 | 5/2003 | Watanabe et al. |
| 6,608,983 | B2 * | 8/2003 | Terazawa et al. ..... 399/258 |
| 6,653,037 | B2 | 11/2003 | Sawada et al. |
| 6,716,561 | B2 | 4/2004 | Shiraishi et al. |
| 6,746,810 | B2 * | 6/2004 | Suzuki et al. ..... 430/119.86 |
| 6,785,496 | B2 * | 8/2004 | Iwata et al. ..... 399/258 |
| 6,821,698 | B2 | 11/2004 | Sawada et al. |
| 6,852,459 | B2 | 2/2005 | Katoh et al. |

(Continued)

FOREIGN PATENT DOCUMENTS

EP 0 886 187 A2 12/1998

(Continued)

OTHER PUBLICATIONS

Dr. Alan Rawle, Particle Sizing—An Introduction, 20001-2005 copy right, Silver Colloids, Tutorials, pp. 1-4.*

*Primary Examiner* — David M Gray
*Assistant Examiner* — Francis Gray
(74) *Attorney, Agent, or Firm* — Oblon, Spivak, McClelland, Maier & Neustadt, L.L.P.

(57) ABSTRACT

The invention provides a developer supply device, a developer container, a developer and an image forming apparatus such that the developer is discharged stably from the developer container with a stable toner concentration in the developer, without damaging the developer, and in a relatively simple and small-size device having a relatively high degree of freedom as regards layout. The developer supply device comprises a partially or wholly deformable developer container and a pump for suctioning the developer held in the developer container, together with a gas, and for discharging the developer towards a developing unit. The toner comprises an additive formed so as to have a volume average particle size of 50 to 500 nm. The carrier is formed so as to have a weight average particle size of 20 to 60 μm. The developer is formed so that the carrier concentration thereof is 1 to 30 wt %.

15 Claims, 9 Drawing Sheets

U.S. PATENT DOCUMENTS

| | | | | |
|---|---|---|---|---|
| 6,858,365 | B2 | 2/2005 | Sawada et al. | |
| 7,052,815 | B2 | 5/2006 | Sawada et al. | |
| 7,060,407 | B2 | 6/2006 | Nagayama et al. | |
| 7,070,899 | B2 * | 7/2006 | Yanagida et al. | 430/110.3 |
| 7,122,286 | B2 | 10/2006 | Suzuki et al. | |
| 7,132,210 | B2 | 11/2006 | Suzuki et al. | |
| 7,163,774 | B2 | 1/2007 | Shiraishi et al. | |
| 7,217,485 | B2 | 5/2007 | Hasegawa et al. | |
| 2003/0235436 | A1 * | 12/2003 | Kasahara et al. | 399/258 |
| 2004/0247343 | A1 | 12/2004 | Matsumoto et al. | |
| 2005/0008961 | A1 | 1/2005 | Takada et al. | |
| 2005/0214670 | A1 | 9/2005 | Matsumoto et al. | |
| 2005/0277046 | A1 | 12/2005 | Sawada et al. | |
| 2006/0165443 | A1 * | 7/2006 | Yoshinaga et al. | 399/325 |
| 2006/0222987 | A1 | 10/2006 | Suzuki et al. | |
| 2007/0116494 | A1 | 5/2007 | Uno et al. | |
| 2008/0181630 | A1 * | 7/2008 | Matsumoto et al. | 399/27 |
| 2008/0187332 | A1 * | 8/2008 | Tsuda et al. | 399/27 |
| 2008/0279592 | A1 * | 11/2008 | Matsumoto et al. | 399/259 |
| 2008/0310865 | A1 * | 12/2008 | Uno et al. | 399/30 |
| 2009/0016777 | A1 * | 1/2009 | Miyamoto et al. | 399/238 |
| 2009/0103935 | A1 * | 4/2009 | Uno et al. | 399/49 |
| 2009/0110425 | A1 * | 4/2009 | Uno et al. | 399/61 |

FOREIGN PATENT DOCUMENTS

| | | | |
|---|---|---|---|
| EP | 1 426 829 | A2 | 6/2004 |
| JP | 2002-214894 | | 7/2002 |
| JP | 2003-043754 | | 2/2003 |
| JP | 2004-29306 | | 1/2004 |
| JP | 2005-195755 | | 7/2005 |
| JP | 2005-257967 | | 9/2005 |
| JP | 2007-133057 | | 5/2007 |
| JP | 2007-183348 | | 7/2007 |

* cited by examiner

FIG. 6A

FIG. 6 FIG. 6A FIG. 6B

| | 20TH TO 29TH DISCHARGE | | | 60TH TO 69TH DISCHARGE | | |
|---|---|---|---|---|---|---|
| | AVERAGE DISCHARGE AMOUNT (g) | STANDARD DEVIATION | CARRIER CONCENT-RATION (WT%) | AVERAGE DISCHARGE AMOUNT (g) | STANDARD DEVIATION | CARRIER CONCENT-RATION (WT%) |
| EXAMPLE 1 | 4.03 | 0.088 | 10.6 | 4.41 | 0.052 | 9.9 |
| COMPARATIVE EXAMPLE 1 | 4.29 | 0.086 | 10.8 | 4.17 | 0.068 | 9.7 |
| COMPARATIVE EXAMPLE 2 | 4.77 | 0.200 | 12.0 | 4.13 | 0.093 | 8.9 |
| EXAMPLE 2 | 4.24 | 0.078 | 10.3 | 4.27 | 0.056 | 9.9 |
| EXAMPLE 3 | 4.70 | 0.064 | 20.6 | 4.71 | 0.066 | 19.6 |
| COMPARATIVE EXAMPLE 3 | 4.87 | 0.196 | 27.2 | 5.03 | 0.358 | 37.0 |
| EXAMPLE 4 | 4.51 | 0.059 | 15.3 | 4.51 | 0.062 | 15.1 |

FIG. 6B

| 100TH TO 109TH DISCHARGE | | |
|---|---|---|
| AVERAGE DISCHARGE AMOUNT (g) | STANDARD DEVIATION | CARRIER CONCENT-RATION (WT%) |
| 4.22 | 0.051 | 9.2 |
| 3.54 | 0.039 | 10.1 |
| 3.91 | 0.055 | 6.4 |
| 4.25 | 0.041 | 10.2 |
| 4.69 | 0.050 | 20.1 |
| 5.10 | 0.099 | 31.3 |
| 4.48 | 0.070 | 15.3 |

FIG. 7A

FIG. 7 FIG. 7A FIG. 7B

| | INITIAL | | | |
|---|---|---|---|---|
| | IMAGE DENSITY | BACKGROUND STAINING | FINE-LINE REPRODUCI-BILITY | TRANSFER-ABILITY |
| EXAMPLE 1 | 5 | 5 | 4 | 4 |
| COMPARATIVE EXAMPLE 1 | 4 | 5 | 4 | 3 |
| COMPARATIVE EXAMPLE 2 | 5 | 4 | 4 | 4 |
| EXAMPLE 2 | 5 | 5 | 5 | 4 |
| EXAMPLE 3 | 5 | 5 | 5 | 4 |
| COMPARATIVE EXAMPLE 3 | 5 | 5 | 5 | 4 |
| EXAMPLE 4 | 5 | 5 | 5 | 5 |

FIG. 7B

| | AFTER 100,000 SHEET OUTPUT | | | | |
|---|---|---|---|---|---|
| CLEAN-ABILITY | IMAGE DENSITY | BACKGROUND STAINING | FINE-LINE REPRODUCI-BILITY | TRANSFER-ABILITY | CLEAN-ABILITY |
| 5 | 4 | 3 | 3 | 3 | 2 |
| 4 | 2 | 2 | 2 | 2 | 1 |
| 5 | 4 | 1 | 2 | 3 | 2 |
| 5 | 5 | 4 | 4 | 4 | 3 |
| 5 | 5 | 5 | 5 | 4 | 3 |
| 5 | 2 | 2 | 1 | 1 | 3 |
| 5 | 5 | 5 | 5 | 5 | 2 |

DEVELOPER SUPPLY DEVICE AND IMAGE FORMING APPARATUS COMPRISING SAME

BACKGROUND OF THE INVENTION

1. Field of the Invention

The present invention relates to an image forming apparatus using electrophotography, such as, for instance, a copying machine, a printer, a fax device, or a multifunction device comprising the foregoing, and more particularly to a developer supply device for supplying a two-component developer comprising a toner and a carrier to a developing unit, and relates to a developer container and a developer used in this developer supply device.

2. Description of the Related Art

Conventional image forming apparatuses using electrophotography, such as copying machines, printers and the like, use known technologies (for instance, as disclosed in Japanese Unexamined Patent Application Laid-open No. 2001-194860) in which developer is replaced by suitably replenishing a fresh two-component developer into a developing unit (developing device) that holds a two-component developer comprising a toner and a carrier (including developers where an additive or the like is added), this system being called the trickle developing system.

In developing devices using two-component developers, toner is suitably replenished into the developing device through an opening provided on part of the developing device, in accordance with toner consumption in the developing device. The replenished toner is stirred and mixed, through the action of a stirring member such as a transport screw or the like, with the developer inside the developing device. Part of the stirred/mixed developer is supplied to a developing roller. The amount of developer supported on the developing roller is suitably adjusted by a doctor blade, after which the toner in the two-component developer adheres to a latent image on a photosensitive drum at a position opposite the photosensitive drum.

During an ordinary developing process, thus, the carrier in the two-component developer held in the developing device remains inside the developing device without becoming consumed, and, as a result, the carrier deteriorates over time. Specifically, the stirring and mixing of the carrier inside the developing device over longs periods of time gives rise to a "film shaving phenomenon" that involves wear and/or delamination of the carrier coating, thereby lowering the charge power of the carrier, and a "spent phenomenon" in which the components of the toner and/or additives adhere to the surface of the carrier thereby lowering the charge power of the latter.

Trickle developing is a developing method for preventing loss of image quality in output images resulting from such degradation of the carrier over time. Specifically, fresh two-component developer (premix toner) is suitably replenished into the developing device, while part of the two-component developer held in the developing device is suitably discharged out of the developing device, thereby reducing degraded carrier in the developing device and maintaining the amount of developer held in the developing device, and preserving the charge power of the developer.

Image forming apparatuses using trickle developing afford a more stable output image quality over time than apparatuses in which the developing device and/or the developer must be replaced by new ones whenever the carrier deteriorates over time.

Japanese Unexamined Patent Application Laid-open No. 2004-29306 discloses a technology of an image forming apparatus using trickle developing, in which a two-component developer having, for instance, prescribed blending ratios of toner and carrier, is held in a bolt-shaped developer container having spiral protrusions on the inner wall thereof. In technologies such as the one of Japanese Unexamined Patent Application Laid-open No. 2004-29306, the developer is discharged from an opening through rotational driving of the bottle-shaped developer container.

Japanese Unexamined Patent Application Laid-open No. 2002-214894 discloses a toner-replenishing device for transporting toner contained in a toner-holding container to a developing device, using a screw pump (Mohno pump). Specifically, a flexible toner-holding container is removably installed in the image forming apparatus body. The toner-holding container arranged in the apparatus body is connected to a tube via a nozzle having a toner discharge outlet. One end of the tube is connected to the screw pump. The screw pump comprises, for instance, a rotor, a stator, an inlet, a universal joint, and a motor. Negative pressure (suction pressure) is formed inside the tube as a result of the rotation of the rotor inside the stator in a predetermined direction, through the action of the motor, whereby the toner held in the toner-holding container is discharged out of the toner discharge outlet and moves inside the tube together with air. The toner moving inside the tube is suctioned through the inlet of the screw pump, is then fed into the gaps between the stator and the rotor, and is sent to the other end along with the rotation of the rotor. The fed toner is discharged through the feeding outlet of the screw pump, and is replenished into the developing device.

In such a toner replenishing device, the toner transport channel between the toner-holding container, as a toner supply source, and the developing device to which the toner is supplied, can be formed of a flexible tube, which, as is known, increases the degree of freedom for configuring the layout of the overall image forming apparatus. Specifically, a toner replenishing device using a screw pump transports toner as a result of pressure generated inside the flexible tube through suction of air out of the tube. This allows setting relatively freely the layout of the toner-holding container, the developing device and the toner supply channel, and allows thus reducing the size of the image forming apparatus.

In the technology disclosed in the above-described Japanese Unexamined Patent Application Laid-open No. 2004-29306 and the like, the specific gravity of the carrier is larger than the specific gravity of the toner, which made separation of the toner and the carrier very likely during the rotation of the bottle-shaped developer container. Image quality such as image density and the like may be become unstable when the proportions of toner and carrier (toner concentration) cannot be kept constant in the developer that is being transported towards the developing device. Also, toner aggregates may also form during the rotation of the bottle-shaped developer container, which may give rise to abnormal images such as white spots and the like.

In order to solve such problems, it would be conceivable to use the technology of, for instance, the above Japanese Unexamined Patent Application Laid-open No. 2002-214894, and transport together air and a developer (premix toner) in which a toner and a carrier are mixed beforehand, using a pump such as an air pump or a screw pump. Since there would be no rotational driving of the developer container in which the developer is held, no toner aggregates would form, and the developer would not undergo mechanical stresses, thus reducing the likelihood of problems such as toner and carrier separation.

In such a case, however, the developer held in the flexible developer container must be discharged stably. That is, if the carrier gap in the developer container is insufficient, it is highly probable that the developer cannot be supplied (discharged) stably from the developer container, but providing the above-described gap in a sufficient manner results in the developer container having a larger size.

Technologies relating to the present invention are also disclosed in, e.g., Japanese Unexamined Patent Application Laid-open No. 2005-195755.

SUMMARY OF THE INVENTION

In order to solve the above-described problems, it is an object of the invention to provide a developer supply device, as well as a developer container and a developer used in this developer supply device, such that the developer is discharged stably from the developer container with a stable toner concentration in the developer, without damaging the developer, and in a relatively simple and small-size device having a relatively high degree of freedom as regards layout.

Another object of the invention is to provide an image forming apparatus comprising such a developer supply device.

In an aspect of the present invention, a developer supply device supplies a developer comprising a toner and a carrier to a developing unit. The developer supply device comprises a partially or wholly deformable developer container for holding the developer; and a pump for suctioning the developer held in the developer container, together with a gas, and for discharging the developer towards the developing unit. The toner comprises an additive formed so as to have a volume average particle size of 50 to 500 nm, the carrier is formed so as to have a weight average particle size of 20 to 60 μm, and the developer is formed so that the carrier concentration thereof is 1 to 30 wt %.

In another aspect of the present invention, a partially or wholly deformable developer container is removably installed in a developer supply device, for holding a developer comprising a toner and a carrier. The developer supply device has a pump for suctioning said developer held in the developer container, together with a gas, and for discharging the developer towards a developing unit. The toner comprises an additive formed so as to have a volume average particle size of 50 to 500 nm, the carrier is formed so as to have a weight average particle size of 20 to 60 μm, and the developer is formed so that the carrier concentration thereof is 1 to 30 wt %.

In another aspect of the present invention, a developer comprises a toner and a carrier and which is held in a developer container. The developer container is partially or wholly deformable. The toner comprises an additive formed so as to have a volume average particle size of 50 to 500 nm, the carrier is formed so as to have a weight average particle size of 20 to 60 μm, and the developer is formed so that the carrier concentration thereof is 1 to 30 wt %.

BRIEF DESCRIPTION OF THE DRAWINGS

The above and other objects, features and advantages of the present invention will become more apparent from the following detailed description taken with the accompanying drawings in which:

FIG. 6 is a table listing running test results; and

FIG. 7 is another table listing running test results.

DESCRIPTION OF THE PREFERRED EMBODIMENTS

Figure 1:
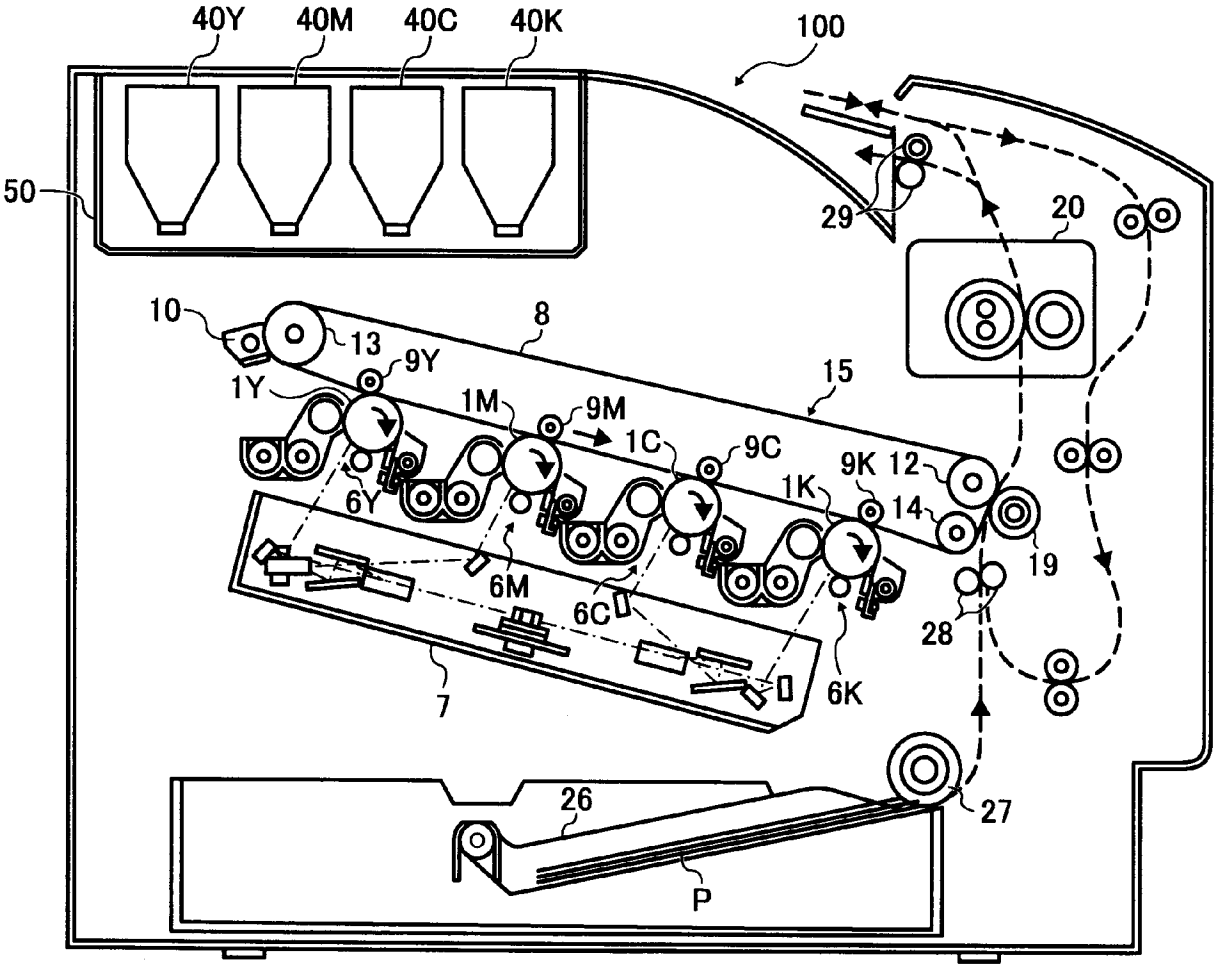
FIG. 1 is an overall schematic diagram illustrating an image forming apparatus in a first embodiment of the invention.

Various embodiments of the present invention are explained in detail next with reference to accompanying drawings. Identical or corresponding portions in the drawings are referred to with identical reference numerals, the overlapping explanation thereof being simplified or omitted.

First Embodiment

The first embodiment is explained with reference to FIGS. 1 to 4.

Figure 2:
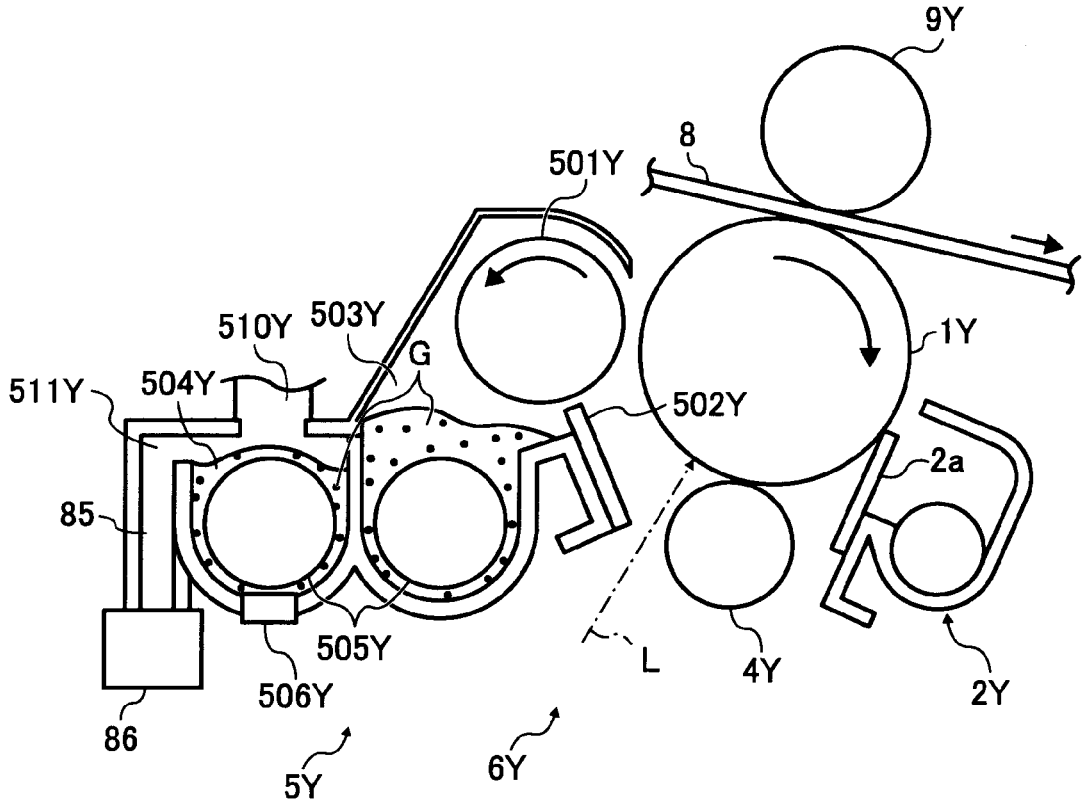
FIG. 2 is a cross-sectional diagram illustrating the constitution of an image forming unit in the image forming apparatus.
Figure 3:
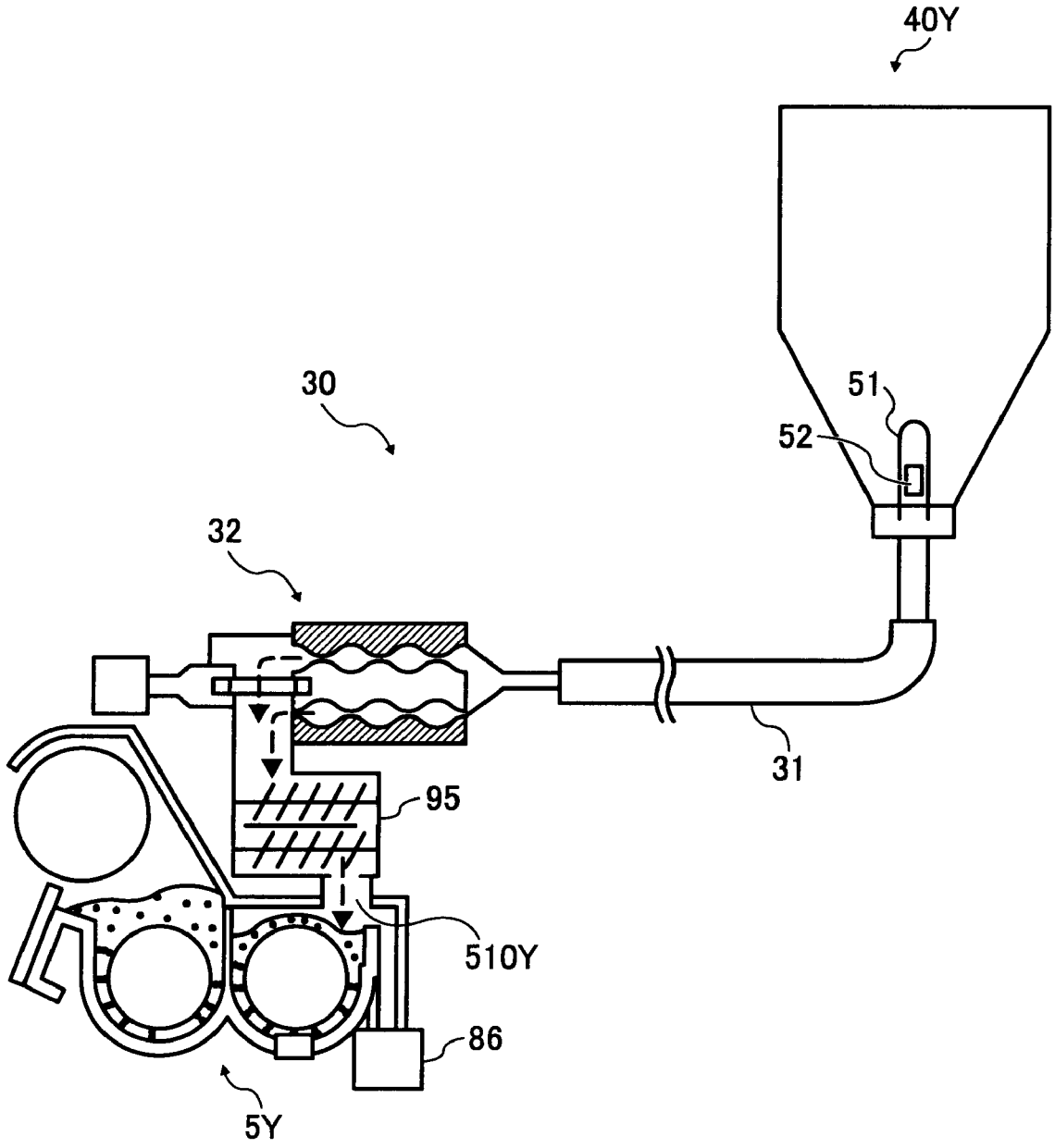
FIG. 3 is a diagram illustrating schematically the constitution of a developer supply channel in the image forming apparatus.
Figure 4:
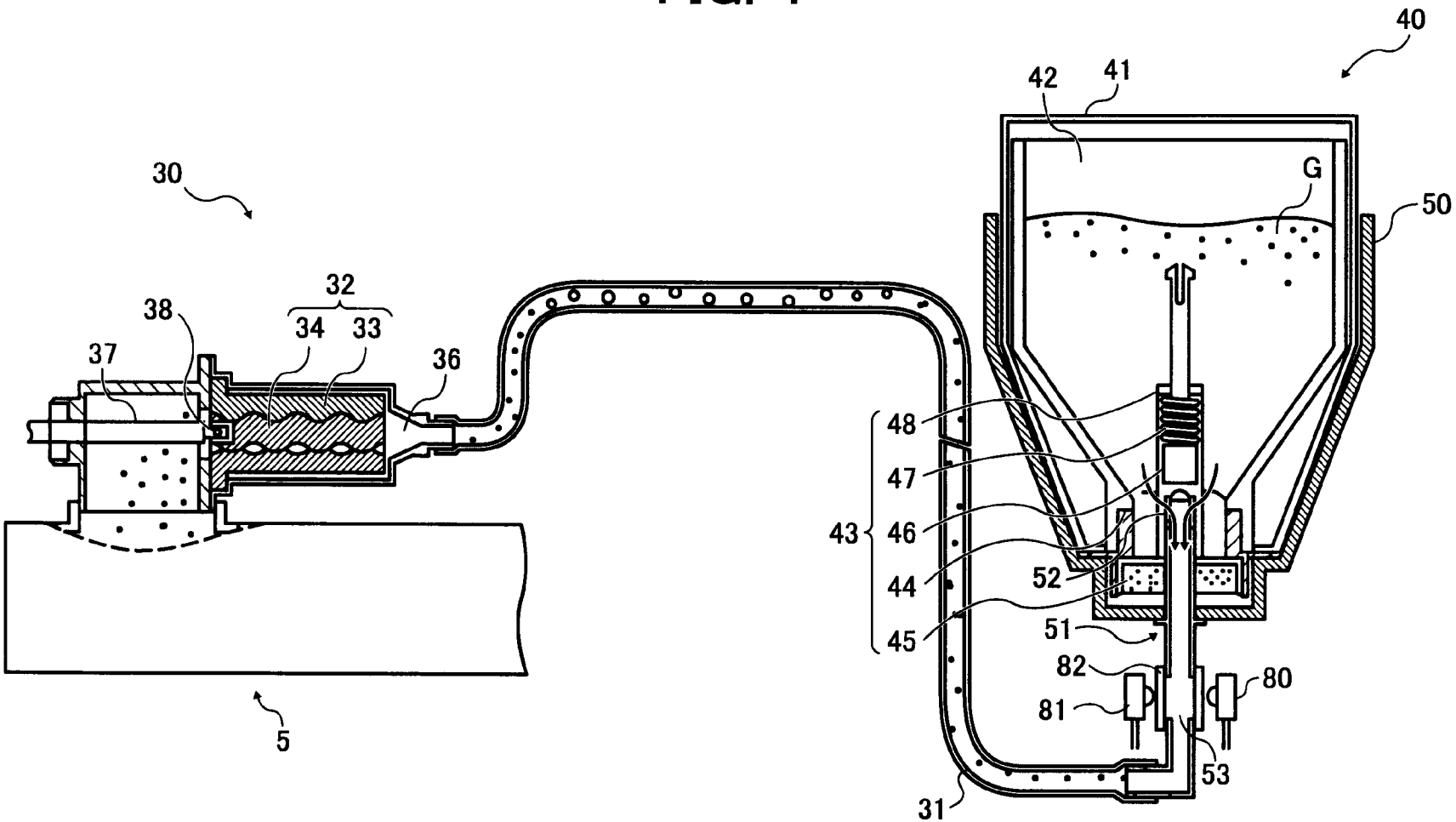
FIG. 4 is a cross-sectional diagram illustrating schematically the constitution of a developer supply device.

FIG. 1 is an overall schematic diagram illustrating a printer as the image forming apparatus; FIG. 2 is an enlarged diagram illustrating image forming units thereof; FIG. 3 is a schematic diagram illustrating a developer supply channel thereof; and FIG. 4 is a cross-sectional diagram illustrating a developer supply device.

As illustrated in FIG. 1, four developer containers 40Y, 40M, 40C and 40K corresponding to various colors (yellow, magenta, cyan, and black) are removably (exchangeably) arranged on a developer container holding unit 50 provided on the upper portion of an image forming apparatus body 100. Below the developer container holding unit 50 there is arranged an intermediate transfer unit 15. Image forming units 6Y, 6M, 6C and 6K corresponding to various colors (yellow, magenta, cyan, and black) are provided so as to oppose an intermediate transfer belt 8 of the intermediate transfer unit 15.

With reference to FIG. 2, the image forming unit 6Y corresponding to yellow comprises, for instance, a photoconductive drum 1Y, a charger 4Y provided around the photoconductive drum 1Y, a developing device 5Y (developing unit), a cleaner 2Y and a discharger (not shown). The image forming process (charging, exposure, developing, transfer and cleaning) is carried out on the photosensitive drum 1Y to form a yellow image on the photosensitive drum 1Y.

Except for the color of the toner used, the other three image forming units 6M, 6C and 6K have substantially the same constitution as the image forming unit 6Y corresponding to yellow, and form images corresponding to their respective toner colors. Explanation on the other three image forming units 6M, 6C and 6K is omitted accordingly, and only the image forming unit 6Y corresponding to yellow is explained. With reference to FIG. 2, the photosensitive drum 1Y is rotated clockwise in FIG. 2 by a driving motor not shown. The surface of the photosensitive drum 1Y is charged uniformly at the position of the charger 4Y (charging step). The surface of the photosensitive drum 1Y reaches then the irradiation position of the laser beam L emitted by an exposure device 7 (see FIG. 1), at which position an electrostatic latent image corresponding to yellow is formed through exposure scanning (exposure step).

Thereafter, the surface of the photosensitive drum 1Y reaches a position opposite the developing device 5Y, at which position the electrostatic latent image is developed to form a yellow toner image (developing step). Subsequently, the surface of the photosensitive drum 1Y reaches a position opposing the intermediate transfer belt 8 and a first transfer bias roller 9Y, at which position the toner image on the photosensitive drum 1Y is transferred to the intermediate transfer belt 8 (primary transfer step). At this time a small amount of non-transferred toner remains on the photosensitive drum 1Y.

Thereafter, the surface of the photosensitive drum 1Y reaches a position opposite the cleaning unit 2Y, at which position the non-transferred toner remaining on the photosensitive drum 1Y is mechanically recovered by a cleaning blade 2*a* (cleaning step).

Lastly, the surface of the photosensitive drum 1Y reaches a position opposite a discharger not shown in the figure, at which position the residual potential on the photosensitive drum 1Y is discharged.

Therewith ends the series of image formation processes carried out on the photosensitive drum 1Y.

The above-described image forming processes are carried out in the other three image forming units 6M, 6C and 6K in the same way as in the yellow image forming unit 6Y. That is, an exposure device 7 arranged underneath these image forming units irradiates laser light L, based on image information, on the photosensitive drums of the various image forming units 6M, 6C and 6K. Specifically, the exposure device 7 emits a laser beam L from a light source, and irradiates the laser beam L on the photosensitive drums via plural optical elements while scanning the laser beam by means of a rotationally driven polygon mirror. Thereafter, in the developing process, the toner images of various colors formed on the photosensitive drums are superposedly transferred to the intermediate transfer belt 8. A color image is thus formed on the intermediate transfer belt 8.

With reference to FIG. 1, the intermediate transfer unit 15 comprises, for instance, the intermediate transfer belt 8, four primary transfer bias rollers 9Y, 9M, 9C and 9K, a secondary transfer backup roller 12, a cleaning backup roller 13, a tension roller 14, and an intermediate transfer cleaning unit 10. The intermediate transfer belt 8 is stretched/supported by three rollers 12 to 14, and is endlessly moved in the direction denoted by the arrow in FIG. 1 as a result of rotation driving by one roller 12.

The four primary transfer bias rollers 9Y, 9M, 9C and 9K and the photosensitive drums 1Y, 1M, 1C and 1K flank respectively the intermediate transfer belt 8 thereby forming the primary transfer nips. A transfer bias having a polarity opposite to that of the toners is applied to the primary transfer bias rollers 9Y, 9M, 9C and 9K.

The intermediate transfer belt 8, moving in the direction of the arrow, sequentially passes through the primary transfer nips of the primary transfer bias rollers 9Y, 9M, 9C and 9K. The toner images of the various colors on the photosensitive drums 1Y, 1M, 1C and 1K are superposedly primary-transferred to the intermediate transfer belt 8.

Thereafter, the intermediate transfer belt 8 having superposedly transferred thereon the toner images of respective colors, reaches a position opposite a secondary transfer roller 19. At this position, the secondary transfer backup roller 12 and the secondary transfer roller 19 flank the intermediate transfer belt 8, thereby forming the secondary transfer nip. The four-color toner image formed on the intermediate transfer belt 8 is transferred to a sheet of transfer material P such as transfer paper or the like which is transported to the secondary transfer nip position. At this time, non-transferred toner that has not been transferred to the transfer material P remains on the intermediate transfer belt 8.

Thereafter, the intermediate transfer belt 8 reaches the position of the intermediate transfer cleaning unit 10. At this position, the non-transferred toner on the intermediate transfer belt 8 is recovered.

Therewith ends the series of transfer processes carried out on the intermediate transfer belt 8.

Herein, the transfer material P transported to the secondary transfer nip position is transported, for instance, from a paper feed unit 26 arranged at the bottom of the apparatus body 100, and via a paper feed roller 27, a pair of resist rollers 28 and the like. Specifically, the paper feed unit 26 contains a plurality of sheets of transfer material P such as transfer paper or the like in a superposed manner.

When the paper feed roller 27 is rotated counterclockwise in FIG. 1, the uppermost sheet of transfer material P is fed toward between the pair of resist rollers 28.

The transfer material P transported to between the pair of resist rollers 28 stops temporarily at the roller nip position of the pair of resist rollers 28, the rotation whereof is then discontinued. With timing in accordance with the color image on the intermediate transfer belt 8, the pair of resist rollers 28 is rotated, whereby the transfer material P is transported towards the secondary transfer nips. The desired color image becomes transferred thus to the transfer material P.

Thereafter, the transfer material P, onto which the color image is transferred at the secondary transfer nip position, is transported to the position of a fixing unit 20. At this position, the color image transferred to the surface is fixed to the transfer material P through heat and pressure by a pressure roller and a fixing roller. Next, the transfer material P passes through between a pair of paper delivering rollers 29 and is discharged out of the apparatus. The transfer material P as the output image, discharged out of the apparatus by the pair of paper delivering rollers 29, is sequentially stacked on a stack portion 30.

Therewith ends the series of image forming processes that takes place in the image forming apparatus.

The constitution and operation of the developing devices (developing units) is explained next in more detail with reference to FIG. 2.

The developing device 5Y comprises, for instance, a developing roller 501Y opposing the photosensitive drum 1Y, a doctor blade 502Y opposing the developing roller 501Y, two transport screws 505Y arranged inside developer holding units 503Y and 504Y, a concentration detection sensor 506Y for detecting the concentration of toner in the developer, and a developer discharge outlet 511Y as a discharge means. The developing roller 501Y comprises, for instance, a magnet fixed therein, and a sleeve rotating around the magnet. A two-component developer G (developer) comprising a carrier and a toner is held in the developer holding units 503Y and 504Y. The developer holding unit 504Y communicates with the developer supply device via an opening 510Y formed on the upper portion of the developer holding unit 504Y.

The developing device 5Y having such a constitution works as follows.

The sleeve of the developing roller 501Y rotates in the arrow direction of FIG. 2. The developer G supported on the developing roller 501Y as a result of the magnetic field generated by the magnet moves over the developing roller 501Y as the sleeve rotates.

Herein, the developer G inside the developing device 5Y is adjusted so that the toner proportion in the developer falls within a predetermined range (for instance, a toner concentration from 1.5 to 5.0 wt %). Specifically, the developer G held in the developer container 40Y is replenished into the developer holding unit 504Y via a developer supply device 30, in accordance with the consumption of toner inside the developing device 5Y. The configuration and operation of the developer supply device 30 is explained in detail later.

Then, the fresh developer replenished into the developer holding unit 504Y is mixed and stirred with the already present developer G and is recirculated therewith through the two developer holding units 503Y and 504Y (moving in the direction perpendicular to the paper in FIG. 2) by the action of the two transport screws 505Y. The toner in the developer G adheres to the carrier on account of frictional static electricity with the latter, and becomes supported on the developing roller 501Y, together with the carrier, by the magnetic field formed on the developing roller 501Y.

The developer G supported on the developing roller 501Y is transported in the direction of the arrow in FIG. 2, and reaches the position of the doctor blade 502Y. The developer G on the developing roller 501Y is optimally dosed at that position, and then is transported up to a position opposite the photosensitive drum 1Y (the developing region). Toner adheres then to the latent image formed on the photosensitive drum 1Y as a result of the electric field formed in the developing region. Thereafter, the developer G remaining on the developing roller 501Y reaches, through the rotation of the screw, the upper portion of the developer holding unit 503Y, at which position the residual developer G is removed from the developing roller 501Y.

With reference to FIG. 3, when the developer container 40Y is set on a developer container support of the apparatus body, a nozzle 51 (relay member) connects with the developer container 40Y (see FIG. 4). The developer G contained in the developer container 40Y is transported into the developing device 5Y by the developer supply device 30.

Through the action of the developer supply device 30, the developer inside the respective developer containers 40Y, 40M, 40C and 40K arranged in the developer container holding unit 50 of the apparatus body 100 is suitably replenished into the respective developing devices, via respective developer supply channels, in accordance with the toner consumption in the developing devices of the respective colors. Except for the color of the transported toner (developer), the constitutions of the four developer supply channels (developer supply devices) are substantially identical.

The developing device 5Y in the present embodiment uses a trickle developer method.

As illustrated in FIGS. 2 and 3, in the image forming apparatus in the present embodiment there is provided a developer discharge outlet 511Y, as a discharge means for discharging part of the developer G contained in the developing device 5Y out of the developing device 5Y. Specifically, the developer discharge outlet 511Y is provided, as a discharge means, in the vicinity of the upper end of the wall face of the developer holding unit 504Y.

When the amount of developer in the developing device 5Y exceeds a predetermined amount as a result of replenishment of fresh developer G from the developer container 40Y into the developing device 5Y, via the developer supply device 30, the excess developer G is discharged out of the developing device 5Y through the developer discharge outlet 511Y (overflow method). The developer G discharged through the developer discharge outlet 511Y is transported up to a developer recovery unit 86 via a developer recovery channel 85.

Thus, the developer level surface rises as the fresh developer G is replenished in such a way that the developer G that exceeds the height of the developer discharge outlet 511Y is discharged out of the developing device 5Y. As a result, the developer level surface (developer amount) inside the developing device 5Y is kept constant at all times.

In the present embodiment, thus, fresh developer (fresh carrier) is suitably replenished into the developing device 5Y, while part of the developer held in the developing device 5Y is suitably discharged out of the developing device 5Y, making it thus possible to maintain the electrostatic power and the amount of developer held in the developing device 5Y by reducing deteriorated carrier in the developing device 5Y.

Although in the present embodiment an overflow method is used as a discharge means for discharging developer out of the developing device 5Y, the developer may also be discharged through opening and closing of an openable and closable shutter provided in the developer discharge outlet.

The developer supply device 30 that brings the toner in the developer container 40 to the developing device 5Y is explained in detail next with reference to FIGS. 3 and 4. In FIG. 4 the letter symbols (Y, M, C, BK) of the developer container and the developing device have been omitted.

As illustrated in FIG. 4, the developer supply device 30 comprises, for instance, the developer container 40 that contains fresh developer, a screw pump 32 to 38 as a pump, a tube 31 as a transport pipe, and a nozzle 51 as a relay member.

The screw pump in the present embodiment is a suction-type pump comprising a rotor 34 and a stator 33, such that suction force is generated at the suction opening 36 through the action of the rotor 34 (negative pressure is generated through extraction of air from the tube 31).

A screw pump main unit 32 comprises the stator 33 and the rotor 34. The stator 33, which is a female screw-like member comprising an elastic material such as rubber or the like, has formed therein a double-pitch spiral groove. The rotor 34, which is a male screw-like member comprising a metal, resin or the like rotatably fits in the stator 33. The rotor 34 is coupled to a driving shaft 37 via a spring pin 38, and is rotationally driven through the rotation of the driving shaft 37. The rotation drive of the driving shaft 37 is eccentric, and thus the screw pump is called also a uniaxial eccentric screw pump. Herein, a suction force is generated in the suction opening 36 as a result of the rotation of the rotor 34, such that the developer sucked in through the suction opening 36 is discharged in the direction of the driving shaft 37 (to the side of a sub-hopper 95).

The tube 31 as the transport pipe comprises a material having excellent pliability and toner resistance, and is formed to an inner diameter of 2 to 8 mm. Materials that can be used in the tube 31 include, for instance, rubbers materials such as polyurethane, nitrile, EPDM, silicone, and/or elastomer resins. Using such a flexible tube 31 increases the degree of freedom for configuring the layout of the developer supply channel, and reduces the size of the image forming apparatus. Also, the developer supply device 30 in the first embodiment feeds developer as a result of the pressure generated in the tube 31 by the screw pump, which allows arranging the developer container 40 at a lower position than that of the developing device 5.

One end of the tube 31 is connected to the suction opening 36 of the screw pump, while the other end is connected to the nozzle 51. The developer container 40 is removably installed in the nozzle 51. The developer G inside the developer container 40 moves into the tube 31 via a developer discharge opening 52 provided at the tip of the nozzle 51.

In a transport channel 53 of the nozzle 51 there is provided a residual amount detecting means 80 to 82 (end detecting means) for detecting the residual amount of developer G in the developer container 40. The residual amount detecting means comprises, for instance, a light-emitting element 80, a light-receiving element 81, a glass tube 82 and the like. When there is developer in the transport channel 53, the amount of light received by the light-receiving element 81 is greater than when there is no developer. This allows detecting the presence or absence of developer in the transport channel 53.

The developer container 40 attachable to/detachable from the nozzle 51 (image forming apparatus body 100) is explained in detail next.

With reference to FIG. 4, the developer container 40 is held by a developer container support 50 of the apparatus body 100. The developer container 40 comprises a deformable bag-shaped main container 42, and a protective case 41 comprising a mouth member 43. The main container 42 is a bag-shaped container for preserving air-tightness and which comprises a folded up flexible sheet material (or four welded sheets) of paper or a resin material such as polyethylene, nylon or the like (with a single-layer or multilayer constitution having a thickness of about 50 to 250 μm). The protective case 41, which is formed of a material such as rigid paper, cardboard, plastic or the like, covers the periphery of the main container 42, while part thereof is integrally installed with the mouth member 43.

The mouth member 43 is heat-welded (or bonded) to an opening of the bag-shaped main container 42. The mouth member 43 comprises, for instance, a case 44 comprising resin, paper or the like, a seal 45 comprising foamed polyurethane or the like, a shutter 46, a spring 47 and a shutter case 48. At the tip of the nozzle 51, on the side of the apparatus body, there is formed a developer discharge outlet 52 (opening), while in the axial core of the nozzle 51 there is formed a transport channel 53 (developer discharge channel).

When the developer container 40 is set on the developer container support 50 (when the developer container is attached) the nozzle 51 pushes up the shutter 46 of the mouth member 43 and penetrates into the developer container 40 (situation in FIG. 4). As a result, the main container 42 communicates with the transport channel 53 of the nozzle 51 via the developer discharge outlet 52. Herein, the seal 45, which is hermetically attached to the nozzle 51, prevents developer from leaking out of the developer container 40.

By contrast, when the developer container 40 is pulled up away from the developer container support 50 (when the developer container is detached), the shutter 46 is pushed back to the position of the seal 45 through the urging force of the spring 47. Communication between the main container 42 and the transport channel 53 becomes shut off as a result. The seal 45 is herein in close contact with the shutter 46, thus preventing leakage of the developer from the developer container 40.

Such attachment/detachment operations of the developer container 40 are carried out during replacement of an existing developer container 40 by a fresh one when the developer in the existing developer container 40 is consumed entirely (when the residual amount becomes zero). The developer container 40 in the present first embodiment is deformable and can fold up as the volume thereof decreases, which allows enhancing ease of handling during transport and storage and reducing recovery distribution costs by reducing storage space. Also, developer crosslinking and/or toner aggregation become less likely in the developer container 40 since the volume of the latter decreases gradually through air suction by the screw pump 32 to 38. Moreover, the developer undergoes virtually no mechanical stress.

The developer supply device 30 having the above constitution works as follows.

When the screw pump 32 is operated, the developer G in the developer container 40 is transported up to the suction inlet 36 of the of the screw pump via the nozzle 51 and the tube 31 (transport pipe). Thanks to the air-tightness of the developer supply channel that extends from the main container 42 up to screw pump via the nozzle 51 and the tube 31, the suction force generated by the operation of the screw pump is transmitted, via the tube 31 and the nozzle 51, to the developer in the vicinity of the developer discharge outlet 52 in the main container 42, thereby enabling feeding of the developer.

Thereafter, the developer fed to the suction opening 36 of the screw pump via the tube 31 is fed into the gaps between the stator 33 and the rotor 34 and is fed to the other end (on the side of the driving shaft 37) through the rotation of the rotor 34, as illustrated in FIG. 3. The fed developer is discharged into the sub-hopper 95 provided as a hopper below the developer feeding outlet of the screw pump. The developer discharged into the sub-hopper 95 is then transported by a transport screw and is replenished into the developing device 5Y via the opening 510Y. In the present embodiment, the developer discharged from the developer container 40 is supplied to the developing device 5 via the developer supply device 30 and the sub-hopper 95, but the developer discharged from the developer container 40 may also be supplied directly to the developing device 5 via the developer supply device 30 alone.

Developer replenishment to the developing device 5Y by the developer supply device 30 is carried out in accordance with the output of the concentration detecting sensor 506Y arranged in the developing device 5Y. Specifically, when the concentration detecting sensor 506Y detects that the toner concentration in the developer is low, it emits a replenishment signal such that the screw pump is driven for the time required in accordance with the sensor output.

As explained thus far, the present embodiment uses a flexible developer container 40 capable of volume reduction through suction by the screw pump. This curtails separation of the carrier that is uniformly dispersed once prior to filling in the non-stirred developer container 40, and makes as a result less likely undesirable occurrences such as separation of large-specific gravity carrier that precipitates then in the container, from which it is preferentially discharged. That is, formation of abnormal images on account of defective control of the toner concentration in the developing device can be curbed since a developer (premix toner) having a constant carrier concentration at all times (proportion of carrier in the developer) is replenished into the developing device 5.

Moreover, the toner and the carrier are filled in the developer container 40 while in an electrically charged state, and hence the toner is electrically attached, to a certain degree, on the periphery of the carrier. The carrier particles repel thus one another, hindering thereby carrier aggregation and making it easier to maintain a uniform dispersed state.

In the developer container 40 capable of volume reduction, toner is discharged while the air of the gap in the upper layer portion of the developer container 40 is gradually evacuated. As a result, the developer becomes compressed as the void ratio of the developer container 40 diminishes over time, which is likely to hinder discharge from the developer container 40.

In the present embodiment, by contrast, the characteristic values of the developer are optimized and the carrier and the toner are fully charged, so that the large specific gravity causes the toner to move, together with the easily movable carrier, down to the developer discharge outlet 52, and so that the fully dispersed developer is discharged stably over time from the developer container 40.

In the present embodiment, specifically, the carrier concentration of the developer (proportion of carrier in the developer) ranges from 1 to 30 wt %, (more preferably, from 5 to 20%) with a view of enhancing the uniform dispersibility of the developer in the developer container 40, and of enhancing the dischargeability of the developer in the developer container 40. A carrier concentration below 1 wt % results in little toner adhering electrically to the carrier. A carrier concentration beyond 30 wt % is likely to impair the dischargeability of the developer.

The developer in the present embodiment is obtained by mixing a toner to which is added an external additive of microparticles formed to a volume average particle size (average primary particle size) of 50 to 500 nm (more preferably, 50 to 300 nm), and a carrier formed to an average particle size (weight average particle size) of 20 to 60 μm (preferably, 20 to 45 μm).

Silica or the like having a volume average particle size of 10 to 30 nm is ordinarily used as an external additive added to toner with a view of imparting fluidity. In the first embodiment, by contrast, an additive having a large volume average particle size is externally added to the toner, whereby proper gaps form between the toner particles, thus curbing developer compression as the air in the developer container 40 is evacuated. Adding to the toner an external additive having a relatively large particle size results in gap formation between the carrier and the toner. This increases the carrier surface area, and thus the amount of toner adhesion, which allows curbing spending of the toner constituent components.

A volume average particle size of the additive smaller than 50 nm is less likely to yield gaps between toner particles, owing to the additive falling into recesses on the toner surface. A volume average particle size of the additive larger than 500 nm decreases the fluidity of the developer, thus impairing the dischargeability of the developer from the developer container 40.

The average particle size (20 to 60 μm) of the carrier in the present embodiment is smaller than the average particle size (about 50 to 100 μm) of ordinary carriers. This has the effect of increasing dispersion homogeneity in the toner. Since the surface area of the carrier is increased, moreover, more toner adheres to the carrier, which enhances the dischargeability of the developer (premix toner).

In the present embodiment is used a small-particle size toner having a particle size distribution not too wide, with a view of obtaining high-quality output images. Specifically, the weight average particle size of the toner is set to range from 3 to 8 μm. Moreover, the toner satisfies the relationship $$1.0 \leqq D4/D1 \leqq 1.4,$$

wherein D4 is the weight average particle size and D1 the number average particle size of the toner. This has the effect of enhancing reproducibility of small latent image dots, and of uniformizing the toner charge distribution, thus reducing background staining.

In the present embodiment, moreover, spherical toner is used for enhancing transferability during the transfer process. Specifically, the average circularity of the toner is set to range from 0.93 to 1.00. This decreases the contact area between toner particles and the contact area between toner particles and the photosensitive drums, which enhances transferability as a result.

When using such a toner having a small particle size, spherical shape and narrow particle size distribution, the gaps between toner particles become smaller, which is likely to impair the dischargeability from the developer container. That is why the above-described characteristic value optimization of the developer, aimed at improving the dischargeability of the developer container, is particularly effective.

Although the developer in the present embodiment enhances the dischargeability from the developer container 40, if the void ratio in the developer container 40 is too small, the dischargeability becomes impaired nonetheless. Thus it is preferable to provide an appropriate air layer, so that the developer does not take up the entire capacity inside the developer container 40. In the present embodiment, an air layer occupies at least 12% of the capacity of the developer container 40.

Setting the developer container 40 filled with the above-described developer (premix toner) on the developer supply device affords thus a stable supply of developer optimized for high-quality image towards the developing device 5, thereby curbing developer degradation in the developing device and yielding high-quality images over long periods of time.

The developer contained beforehand in the developing device 5 is preferably the same developer that is held in the developer container 40. This helps preserve characteristics of the initial agent in the developing device 5, and thus allows curbing image quality changes, also when developer (premix toner) is supplied to the developing device 5 from the developer container 40.

The toner used in the present embodiment is further explained below.

The toner used in the present embodiment contains at least a binder resin and a colorant, and if needed, other components such as a release agent, a charge controller and the like. Besides the above additives, fluidizing agents and/or other components may also be added as needed. All conventionally known materials can be used as these materials.

Examples of binder resins include, for instance, homopolymers, copolymers and mixtures thereof, of one, two or more monomers such as styrene, para-chlorostyrene, vinyl toluene, vinyl chloride, vinyl acetate, vinyl propionate, methyl(meth) acrylate, ethyl(meth)acrylate, propyl(meth)acrylate, n-butyl (meth)acrylate, isobutyl (meth)acrylate, dodecyl(meth)acrylate, 2-ethylhexyl (meth)acrylate, lauryl (meth)acrylate, 2-hydroxyethyl (meth)acrylate, hydroxypropyl (meth)acrylate, 2-chloroethyl (meth)acrylate, (meth)acrylonitrile, (meth)acrylamide, (meth)acrylic acid, vinyl methyl ether, vinyl ethyl ether, vinyl isobutyl ether, vinyl methyl ketone, N-vinyl pyrrolidone, N-vinyl pyridine, butadiene or the like. Herein can be used, also, resins such as polyester resins, polyol resins, polyurethane resins, polyamide resins, epoxy resins, rosin, modified rosin, terpene resins, phenolic resins, hydrogenated petroleum resins, ionomer resins, silicone resins, ketone resins, xylene resins and the like, singly or in mixtures thereof.

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like, as well as mixtures of the foregoing. The amount of colorant used ranges ordinarily from 0.1 to 50 parts by weight relative to 100 parts by weight of the binder resin.

Examples of the charge control agent include negrosine dyes, triphenyl methane dyes, chrome-containing metal complex dyes, molybdic acid chelate dyes, rhodamine dyes, alkoxy amines, quaternary ammonium salts (including fluorinated quaternary ammonium salts), alkyl amides, phosphorus or compounds thereof, tungsten or compounds thereof, fluorine activating agents, metal salicilates, metal salts of salicylic acid derivatives, and the like.

The amount of the charge control agent in the present invention is determined according to the type of the binder resin, the presence or absence of additives that are used if necessary, and the process for manufacturing the toner, including the dispersion method, and therefore there is no universal limitation. However, the amount of the charge control agent is preferably 0.1 parts by weight to 10 parts by weight relative to 100 parts by weight of the binder resin, more preferably 2 parts by weight to 5 parts by weight. If the amount of charge control agent is less than 0.1 parts by weight, the negative electric charge of the toner becomes insufficient and impractical. If the amount of charge control agent is more than 10 parts by weight, the chargeability of the toner is excessively large, and the electrostatic attraction with the carrier increases, which impairs as a result flowability of the developer and decreases image density.

Specific examples of the release agent include, for instance, low molecular weight polyolefin waxes such as low molecular weight polyethylene and low molecular weight polypropylene; synthetic hydrocarbon waxes such as Fischer-Tropsch wax; natural waxes such as beeswax, carnauba wax, candelilla wax, rice wax, and montan wax; kerosene waxes such as paraffin wax and microcrystalline wax; higher fatty acids such as stearic acid, palmitic acid, and myristic acid; metallic salts of higher fatty acids; higher fatty acid amides, as well as various modified waxes of the foregoing.

These waxes can be used alone or in combination, and the melting point of the release agent used ranges preferably from 70 to 125° C. A release agent having a melting point of 70° C. or more affords a toner having excellent transferability and durability, while a melting point of 125° C. or less results in rapid fusion during fixing, all of which makes for a reliable release effect. The amount of release agent used ranges preferably from 1 to 15 wt % relative to the toner. Less than 1 wt % results in insufficient offset prevention effect, while beyond 15 wt % transferability and durability are impaired.

As the additive (external additive) are added microparticles having at least a volume average particle size of 50 to 500 nm and a bulk density of 0.3 g/cm$^3$ or more. The external additive is preferably used in an amount of 0.2 to 3 wt % relative to the toner base. An amount smaller than that does not afford the effect of forming appropriate gaps within the toner and between the toner and other elements. An excessive amount, by contrast, impairs fluidity and the associated large desorption amount favors aggregation of the external additive, which lowers image quality.

Other additives may be added, outside the above range, in concert with the above-described additives. In this case, the added microparticles have preferably a small volume average particle size, with a view of enhancing fluidity.

The additive in the present embodiment includes, for instance, inorganic compounds such as $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, $MgSO_4$, $SrTiO_3$ or the like, preferably $SiO_2$, $TiO_2$, $Al_2O_3$. In particular, these inorganic compounds may be subjected to a hydrophobizing treatment using coupling agents such as methyl trimethoxy silane, methyl triethoxy silane, octyl trimethoxy silane or the like.

The additive in the present embodiment includes also organic compounds such as thermoplastic and thermosetting resins, for instance vinyl resins, polyurethane resins, epoxy resins, polyester resins, polyamide resins, polyimide resins, silicon-based resins, phenolic resins, melamine resins, urea resins, anionic resins, ionomer resins, polycarbonate resins and the like. The resin microparticles may be used as a combination of two or more of the foregoing. Preferred herein are vinyl resins, polyurethane resins, epoxy resins, polyester resins, and combinations thereof, in terms of obtaining easily an aqueous dispersion of microscopic spherical resin particles.

Specific examples of vinyl resins include homopolymers or copolymers of vinyl monomers, for instance copolymers of styrene and (meth)acrylic acid esters, styrene-butadiene copolymers, copolymers of (meth)acrylic acid-acrylic acid esters, styrene acrylonitrile copolymers, styrene-maleic anhydride copolymers, styrene-(meth)acrylic acid copolymers and the like.

The additive (microparticles) in the present embodiment is also excellent as a toner for use with the developer in the developing device. That is, the contact surface of the microparticles with the toner particles, the photosensitive drums and the charge-imparting members is extremely small, and contact is uniform, so that the additive affords a substantial adhesive strength lowering action that is effective in enhancing developing and transfer efficiency. Thanks to their work as rollers, the additive microparticles hardly become embedded, or become only slightly embedded, in the toner particles, from which they can be desorbed and be recovered even during cleaning under high stress (high load, high speed or the like) between the cleaning blade and the photosensitive drum, without wearing or damaging the photosensitive drum. This allows obtaining a stable characteristic over longs periods of time. The additive has also the effect of preventing the phenomenon of toner passing over the cleaning blade, the so-called dam effect, by appropriately desorbing from the toner surface and accumulating at the front edge of the cleaning blade.

Methods for manufacturing the toner in the present embodiment include ordinary conventional methods in which toner is obtained by melt kneading of the toner constituent materials, followed by crushing and sorting, but also various other methods not limited thereto, for instance polymerization methods and the like.

Polymerization methods include, for instance, suspension polymerization, emulsion polymerization, dispersion polymerization and the like. Besides polymerization, other methods may also be used, for instance solution suspension methods, polymer suspension methods, as well as elongation reaction methods. In terms of obtaining easily a toner having the above-explained particle size range and circularity it is preferable to use a non-conventional method. The circularity of the toner after crushing and sorting may also be adjusted by means of a thermal treatment. The method for adding the additive in the first embodiment is not particularly restricted, and may involve, for instance, using various known mixing apparatuses for mechanically mixing and attaching toner base particles and the additive, and/or dispersing homogeneously the toner base particles and the additive in a liquid phase, using a surfactant or the like, to elicit adhesion to the particles, followed by drying.

The above-explained toner particle size distribution can be measured using a measurement apparatus for toner particle size distribution in accordance with the Coulter counter method. Such apparatuses include, for instance, the Coulter counter TA-II and the Coulter multisizer II (both from Coulter Co.). The measurement method is explained next.

First, as a dispersing agent, 0.1 to 5 ml of a surfactant (preferably alkylbenzene sulfonate) is added to 100 to 150 ml of an aqueous electrolyte. Herein, the electrolyte is an aqueous solution of NaCl of about 1% prepared by using first-grade sodium chloride, for example, ISOTON-II (from Coulter Co.). Further, 2 to 20 mg of the measurement sample are added to the solution. Then, the electrolyte suspended with the measurement sample is subjected to a dispersion treatment for 1 to 3 minutes in an ultrasonic disperser. The toner particles or toner weight and number are measured, and the weight distribution and number distribution are calculated in the above measurement apparatus, using an aperture of 100 μm as the aperture. The volume average particle size (D4) and the number average particle size (D1) of the toner can be determined from the distributions thus obtained.

The channels used include 13 channels of 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm. The target particles have herein particle sizes of 2.00 μm to less than 40.30 μm.

The above-described circularity of the toner is a value obtained on the basis of the following formula.

Circularity=(peripheral length of a circle having the same area as the projected area of the particle)/(peripheral length of the particle projected image)

This circularity value is an index of the degree of irregularity of the toner particles, and is of 1.00 for perfectly spherical toner, the value becoming lower as the shape of the surface of the toner particles grows in complexity.

Circularity can be measured with a flow-type particle image analyzer FPIA-1000 (by To a Medical Electronics Co., Ltd.). As a specific measurement method, 0.1 to 0.5 ml of a surfactant, preferably alkylbenzene sulfonate, is added as a dispersing agent to 100 to 150 ml of water, cleaned beforehand of solid impurities, in a container, to which 0.1 to 0.5 g of a test sample is further added. The suspension in which the sample has been dispersed is subjected to a dispersion treatment for about one to three minutes using an ultrasonic dispersing apparatus to make the concentration of the dispersion 3,000 to 10,000 particles/μl, and is measured for toner shape and distribution using the above-described apparatus.

The carrier used in the present embodiment is further explained next.

The carrier used in the present embodiment is formed so as to have a weight average particle size of 20 to 60 μm (preferably, of 20 to 45 μm). A carrier having a particle size within this range is superior also as a carrier for use in a developer in a developing device.

If the average particle size of the carrier is smaller than 20 μm, the share of microparticles in the carrier particle distribution increases, whereby magnetization per particle decreases giving rise to carrier scattering. By contrast, an average particle size of the carrier larger than 45 μm makes carrier bristles rougher during the developing process, which may degrade the evenness of solids and halftones (this becomes particularly ostensible for an average particle size larger than 60 μm). Also, toner scattering may occur in small particle size toner owing to the decreased specific surface area.

Except for particle size, the carrier is not particularly limited otherwise, and can be suitably selected as the intended application may require. However, the carrier has preferably a core material and a resin layer covering the core material.

The core material is not particularly limited, and may be selected from among known materials, preferably for instance manganese-strontium (Mn—Sr) materials, manganese-magnesium (Mn—Mg) materials of 50 to 90 emu/g and the like. In terms of ensuring image density, herein are preferred high-magnetization materials such as iron powder (100 emu/g or more), magnetite (75 to 120 emu/g) or the like. In terms of softening the impact on the photosensitive drum by the toner bristles, weakly magnetic materials such as copper-zinc (Cu—Zn) (30 to 80 emu/g) or the like are preferable. These materials may be employed alone or in combinations of two or more.

The material employed as the resin layer of the carrier is not particularly limited, and may be suitably selected from among known resins in accordance with the intended application. Examples of the material of the resin layer include an amino resin, a polyvinyl resin, a polystyrene resin, a halogenated-olefin resin, a polyester resin, a polycarbonate resin, a polyethylene resin, a polyvinyl fluoride resin, a vinylidene fluoride resin, a polytrifluoro ethylene resin, a polyhexafluoro propylene resin, a copolymer of vinylidene fluoride and an acrylic monomer, a copolymer of vinylidene fluoride and vinyl fluoride, a fluoro-terpolymer such as a terpolymer made from tetrafluoroethylene, vinylidene fluoride, and a non-fluorinated fluoride monomer, and a silicone resin. Each of these materials may be employed alone or in combinations of two or more.

The above-described resin layer may contain, as required, a conductive powder. Examples of the conductive powder include metal powder, carbon black, titanium oxide, tin oxide, and zinc oxide. The average particle diameter of the conductive powder is preferably 1 μm or less. If the average particle diameter is more than 1 μm, it may become difficult to control electric resistance.

To form such a carrier resin layer, for instance, a silicone resin or the like is dissolved in a solvent to prepare a coating solvent, and then the coating solvent is evenly coated over the surface of the core material in accordance with a conventional coating process, followed by drying and baking of the coated surface. The coating can be performed by, for example, a soaking process, a spraying process, and a blushing process or the like.

The amount of resin layer in the carrier is preferably 0.01 wt % to 5.0 wt %. If the resin layer amount is less than 0.01 wt %, the resin layer may fail to form over the surface of the core material, while if the resin layer amount is more than 5.0 wt %, the resin layer may become excessively thick giving rise to granulation between carriers, thus precluding obtaining uniform-size carrier particles.

The developer (premix toner) used in the present embodiment is a mixture of the above-described toner and carrier. The toner and the carrier are friction-charged through mixing. Mixing can be carried out herein using known mixing equipment.

Developer (initial agent) contained beforehand in the developing device is also a mixture of the above-described toner and carrier. The content of carrier (carrier concentration) in the developer is not particularly limited, and can be arbitrarily selected depending on the intended application. For instance, the carrier content ranges preferably from 90 to 98 wt %, more preferably from 93 to 97 wt %.

In the present embodiment, as explained above, a developer comprising a toner and a carrier is held in a developer container 40, the developer held in the developer container 40 is transported together with a gas by means of a pump 32, and various characteristic values relating to the developer held in the developer container 40 are optimized. As a result, the developer is discharged stably from the developer container 40 with a stable toner concentration in the developer, without damaging the developer, and in a relatively simple and small-size device having a relatively high degree of freedom as regards layout.

Second Embodiment

A second embodiment of the present invention is explained in detail next with reference to FIG. 5.

Figure 5:
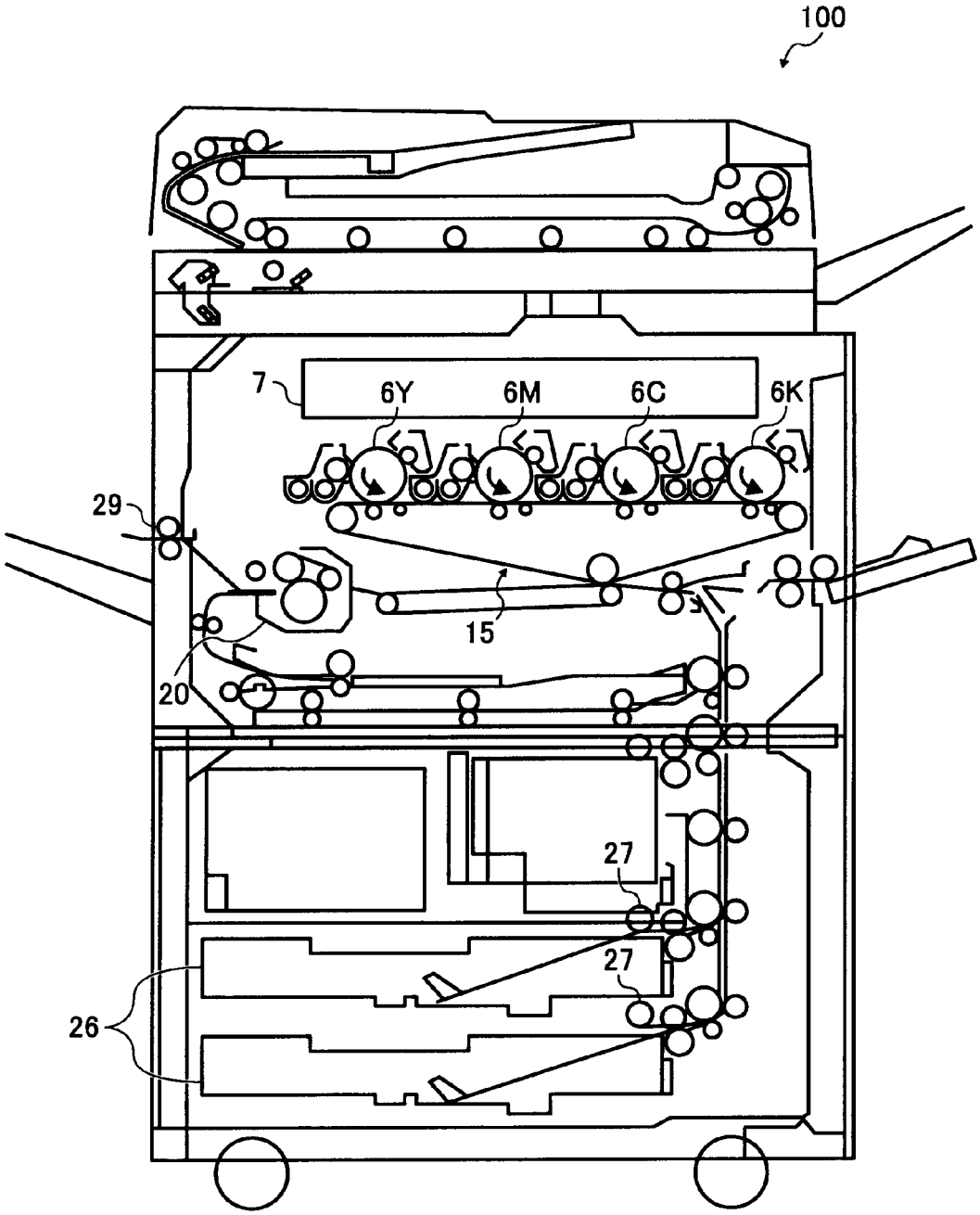
FIG. 5 is a diagram illustrating the overall constitution of an image forming apparatus in a second embodiment of the invention.

FIG. 5 is a diagram illustrating the overall constitution of an image forming apparatus according to this embodiment of the invention. The image forming apparatus of this embodiment differs from that of the first embodiment in that the image forming units 6Y, 6M, 6C and 6K are arrayed above the intermediate transfer unit 15 while in the first embodiment the image forming units 6Y, 6M, 6C and 6K are arrayed below the intermediate transfer unit 15.

As illustrated in FIG. 5, the image forming apparatus 100 according to the present embodiment has the image forming units 6Y, 6M, 6C and 6K arrayed above the intermediate transfer unit 15. As in the first embodiment, each of the image forming units 6Y, 6M, 6C and 6K comprises, for instance, a photoconductive drum, a charger, a developing device (developing unit), a cleaner and a discharger.

In the present embodiment, in FIG. 5 the photosensitive drum rotates counterclockwise, while the intermediate transfer belt rotates clockwise. The developing roller of the developing device (arranged on the left of the photosensitive drum) rotates clockwise, and the doctor blade is arranged above the developing roller.

In the present embodiment, as in the above first embodiment, a developer comprising a toner and a carrier is held in a deformable developer container (not shown), and the developer held in the developer container is transported together with a gas by means of a pump (not shown).

In the present embodiment, the carrier concentration in the developer is set to 1 to 30 wt % (more preferably, 5 to 20 wt %). The developer is obtained by mixing toner to which is added an external additive formed to a volume average particle size of 50 to 500 nm (more preferably, 50 to 300 nm), and a carrier formed to an average particle size (weight average particle size) of 20 to 60 μm (preferably, 20 to 45 μm).

In the present embodiment, as in the first embodiment, a developer comprising a toner and a carrier is held in a developer container, the developer held in the developer container is transported together with a gas by means of a pump, and various characteristic values relating to the developer held in the developer container are optimized. As a result, the developer is discharged stably from the developer container with a stable toner concentration in the developer, without damaging the developer, and in a relatively simple and small-size device having a relatively high degree of freedom as regards layout.

Examples and comparative examples are explained next.

FIG. 6 and FIG. 7 illustrate the results of running tests carried out using the image forming apparatus of the second embodiment. To perform the running test four types of toner (toners a through d) and three kinds of carrier (carriers e through g) were manufactured.

(Manufacture of Toner a)

Toner base constituent materials:

| | |
|---|---|
| Polyester resin (Mw 22,000) | 50 parts |
| Polyester resin (Mw 40,000) | 50 parts |
| Carbon black | 8 parts |
| Carnauba wax (melting point 83° C.) | 5 parts |
| Zinc salicylate | 2 parts |

These toner base constituent materials having the above composition were charged in a Henschel mixer ("MF20C/I" by Mitsui-Miike Engineering Co., Ltd.) and were thoroughly mixed by stirring, after which they were kneaded in a biaxial extruder by Toshiba Kikai Co. Ltd., and were cooled. Next, the mixture was pulverized and classified to manufacture a toner base such that the weight average particle size (D4) was 5.0±0.5 μm, and the ratio (D4/D1) of the weight average particle size to the number average particle size (D1) ranged from 1.40 to 1.45. During kneading, the temperature of the kneaded product at the outlet of the biaxial extruder was set to about 125° C. The average circularity of this base was 0.91. This toner base was mixed with the following additives, using a Henschel mixer, to yield a toner a.

Additives:

| | |
|---|---|
| Hydrophobic silica (Silica hydrophobized with hexamethyl disilazane, average primary particle size 120 nm) | 1.0 part |
| Hydrophobic silica (Silica hydrophobized with hexamethyl disilazane, average primary particle size 20 nm) | 0.8 parts |
| Titanium dioxide (Titanium dioxide hydrophobized isobutyl trimethoxysilane, average primary particle size 15 nm) | 0.8 parts |

(Manufacture of Toner b)

Using the same toner base constituent materials as in toner a, a toner base was prepared in the same way as for toner a, except that herein pulverizing and classification were carried out so as to yield a weight average particle size (D4) of 5.0±0.5 μm, and a ratio (D4/D1) of the weight average particle size to the number average particle size (D1) of 1.15 to 1.20. The average circularity of this base was 0.91. This toner base was mixed with the same additives, and using the same method, as in the toner a, to yield a toner b.

(Manufacture of Toner c)

A toner base was obtained by causing the base of toner b to pass through an apparatus using suffusion (Japan Pneumatic Co. Ltd.) set to a temperature of 300° C., a hot-air flow of 1000 l/min, a charge air flow of 100 l/min, and 600 rpm. The obtained toner base had a weight average particle size (D4) of 5.1 μm, a ratio (D4/D1) of the weight average particle size to the number average particle size (D1) of 1.19, and an average circularity of 0.96. This toner base was mixed with the same additives, and using the same method, as in the toner a, to yield a toner c.

(Manufacture of Toner d)

A toner d was obtained using the base of toner a, mixed with the same additives used in toner a, but excluding herein the 1 part of hydrophobic silica (silica hydrophobized with hexamethyl disilazane, average primary particle size 120 nm).

(Manufacture of Carrier e)

Core Material:

| | |
|---|---|
| Cu—Zn ferrite particles (weight average diameter: 50 μm) | 1000 parts |

Coat Material:

| | |
|---|---|
| Toluene | 80 parts |
| Silicone resin SR2400 (by Toray Dow Corning Silicone Inc., nonvolatile content 50%) | 80 parts |
| Amino silane SH6020 (by Toray Dow Corning Silicone Inc.) | 2 parts |
| Carbon black (# 44 Mitsubishi Chemical Industry Inc.) | 2 parts |

The above coat material was dispersed in a homomixer for 30 minutes to prepare a coat solution. To apply the coat material to the core material, the coat solution and the core material were charged into a coating apparatus provided with a rotary-type bottom plate disk and stirring blades, and in which coating is performed while a spiral flow is formed. Next, the obtained carrier was fired in an electric oven at 250° C. for 2 hours, to yield a carrier e.

(Manufacture of Carrier f)

Core Material:

| | |
|---|---|
| Cu—Zn ferrite particles (weight average diameter: 35 μm) | 1000 parts |

Coat Material:

| | |
|---|---|
| Toluene | 90 parts |
| Silicone resin SR2400 (by Toray Dow Corning Silicone Inc., nonvolatile content 50%) | 90 parts |
| Amino silane SH6020 (by Toray Dow Corning Silicone Inc.) | 2 parts |
| Carbon black (# 44 Mitsubishi Chemical Industry Inc.) | 2 parts |

The above coat material was dispersed in a homomixer for 30 minutes to prepare a coat solution. To apply the coat material to the core material, the coat solution and the core material were charged into a coating apparatus provided with rotary-type bottom plate disk and stirring blades, and in which coating is performed while a spiral flow is formed. Next, the obtained carrier was fired in an electric oven at 250° C. for 2 hours, to yield a carrier f.

(Manufacture of Carrier g)

Core Material:

| | |
|---|---|
| Cu—Zn ferrite particles (weight average diameter: 100 μm) | 1000 parts |

Coat Material:

| | |
|---|---|
| Silicone resin solution SR2100 (by Toray Dow Corning Silicone Inc., nonvolatile content 50%) | 80 parts |
| Carbon black (# 44 Mitsubishi Chemical Industry Inc.) | 3.5 parts |
| Toluene | 100 parts |

The above coat material was dispersed in a homomixer for 30 minutes to prepare a coat solution. To apply the coat material to the core material, the coat solution and the core material were charged into a coating apparatus provided with a rotary-type bottom plate disk and stirring blades, and in which coating is performed while a spiral flow is formed. Next, the obtained carrier was fired in an electric oven at 250° C. for 2 hours, to yield a carrier g.

Example 1 was carried out as described below in order to verify the effect of the above embodiments.

EXAMPLE 1

90 parts of the toner a and 10 parts of the carrier e were stirred and mixed in a tabular mixer, to prepare a developer (premix toner). This developer in an amount of 975 g was filled into a developer container 40 (for black toner) having a capacity of 2650 $cm^3$ in which the air layer took up 35 to 40 vol %. The developer was set in the developer supply device of the image forming apparatus in the second embodiment was set and dischargeability (replenishability) was checked. FIG. 6 illustrates the results obtained. The developer filling the developer container 40 was discharged stably from the developer container.

Next, 7 parts of the toner a and 93 parts of the carrier e were stirred and mixed in a tabular mixer, to yield a developer (initial agent). This developer was filled into a developer container of the second embodiment, and then a running test was carried out in which 100,000 sheets having a monochrome image with an image surface area of 20% were continuously outputted. The output images after continuous output were good from the start, had a high image density, good fine-line reproducibility, and were free of background staining, transfer irregularities or cleaning defects. FIG. 7 illustrates the results obtained.

The evaluation items given in FIGS. 6 and 7 have the following purport.

(Developer Dischargeability from the Developer Container)

The screw pump 32 of the developer supply device 30 and the transport screw of the sub-hopper 95 were operated by being driven for 2 seconds and stopped for 58 seconds, to carry out one replenishment operation. This operation was performed repeatedly. The developer container filled with the developer was shaken up and down 10 times, and was set in the developer supply device. Discharge of the developer began after being left to stand for 10 minutes.

To check stability of the discharge amount, an "average discharge amount" and a "standard deviation" were calculated for 10 successive discharges after the $20^{th}$ discharge, for 10 successive discharges after the $60^{th}$ discharge, and for 10 successive discharges after the $100^{th}$ discharge.

The "carrier concentration" of the developer of the $20^{th}$, $60^{th}$ and $100^{th}$ discharges was measured to verify the homogeneity of the carrier dispersion state. The carrier concentration was calculated by blowing away the toner from weighed developer and by measuring the mass of the remaining carrier.

(Image Density)

Herein was measured the image density of the output of five one-inch×one-inch black solid images located at the four corners and at the center of PPC paper (Type 6200 A4, by Ricoh), as the transfer material P. Image density was measured by spectroscopy (938 spectrodensitometer by X-Rite Corp.). To be non-problematic, image density should have an average value of 1.2 or more. The ranking in FIG. 6 is as follows.

Ranking:

5 . . . . Image density 1.4 or more

4 . . . . Image density 1.3 to 1.4

3 . . . . Image density 1.2 to 1.3

2 . . . . Image density 1.1 to 1.2

1 . . . . Image density less than 1.1

(Background Staining)

A solid white image was outputted on the above-described PPC paper (type 6200 A4) made by Ricoh, and then image density was measured on five arbitrary points. Simultaneously, the image density of five arbitrary points was measured on the same kind of paper but which had not passed through the image forming apparatus. Background staining was evaluated on the basis of the respective average values. An image density value identical to the density of the paper denoted herein an absolute absence of background staining, while a greater density denoted an increasingly worse background staining. The ranking in FIG. 7 is set out below. The permissible range is from rank 3 upward.

Ranking (Increase from White Paper Density)

5 . . . . Less than 0.002

4 . . . 0.002 to 0.005

3 . . . 0.005 to 0.010

2 . . . 0.010 to 0.020

1 . . . 0.0200 or more (Transferability)

The image forming apparatus was forcibly stopped during output of images in which background regions were flanked by four rows×four columns of one-inch×one-inch black solid regions, so that there was a solid portion on the photosensitive drum prior to transfer, and a solid portion on the intermediate transfer belt after transfer. The transfer rate of the solid portions before and after transfer was calculated by comparing the amount of adhered toner. The amount of adhered toner is the value that results from transferring the toner of the solid portions to a tape, and subtracting the weight before transfer from the weight after tape transfer.

Transfer rate (%) solid-portion adhered amount after transfer (mg)÷solid-portion adhered amount before transfer (mg)×100

The ranking in FIG. 7 is set out below.

Ranking: (Permissible Range from Rank 3 Upward)

5 . . . 98% or more

4 . . . 95 to 98%

3 . . . 90 to 95%

2 . . . 85 to 90%

1 . . . . Less than 85%

(Cleanability)

Upon output of A4 black solid images, transfer residual toner on the photosensitive drums after the cleaning process was transferred to a tape, which was pasted to white paper, and the density thereof was measured. To prepare a blank, the same tape but without transferred toner was pasted to white paper, and the density thereof was measured. Cleanability improved as the difference vis-à-vis the blank decreased. Density was measured by spectroscopy (938 spectrodensitometer by X-Rite Corp.). The ranking in FIG. 7 is set out below.

Ranking: (Permissible Range from Rank 2 Upward)

3 . . . No linear or streak-like staining on account of deficient cleaning, density difference with respect to the blank below 0.005

2 . . . No linear or streak-like staining on account of deficient cleaning, density difference with respect to the blank from 0.005 to 0.01

1 . . . . Linear or streak-like staining on account of deficient cleaning, density difference with respect to the blank of 0.01 or more.

(Fine-Line Reproducibility)

A one-dot grid line image, having 600 dot/inch and 150 line/inch both in the main scan and sub-scan directions, was outputted. Line breaking and line thinning were evaluated by visual inspection and were classed into 5 grades. The ranking in FIG. 7 is as follows.

5 . . . . Very good

4 . . . . Good

3 . . . . Ordinary

2 . . . . Poor

1 . . . . Very poor

Other examples and comparative examples were also carried out, as follows.

COMPARATIVE EXAMPLE 1

A developer was manufactured as in Example 1, but changing herein the toner a of Example 1 by the toner d. The developer was evaluated in the same way as in Example 1. Since the additive lacks relatively large-size particles, stability of the amount of developer discharged was worse than that of Example 1, and toner concentration was at times lower than in Example 1. Accordingly, the developer tended to deteriorate, and image density decreased after output of 100,000 sheets. Cleanability was also insufficient.

COMPARATIVE EXAMPLE 2

A developer was manufactured as in Example 1, but changing herein the carrier e of Example 1 by the carrier g. The developer was evaluated in the same way as in Example 1. Homogeneity of the developer was worse on account of the large particle size of the carrier. The developer deteriorated more easily than was the case in Example 1, arguably because of the variability in the amount of carrier and of toner that were replenished, and resulted in an unacceptable level of background staining after output of 100,000 sheets.

EXAMPLE 2

A developer was manufactured as in Example 1, but changing herein the toner a of Example 1 by the toner b and the carrier e by the carrier f. The developer was evaluated in the same way as in Example 1. The dischargeability of the developer improved owing to the enhanced fluidity brought about by the decrease in toner micropowder. The particle size of the carrier was smaller, which enhanced developer homogeneity. In addition, initial image was good and image deterioration decreased.

EXAMPLE 3

A developer was manufactured as in Example 2 but using herein 80 parts of the toner b and 20 parts of the carrier f of Example 2.1040 g of this developer were filled in the same developer container 40 as in Example 1, having an air layer taking up 35 to 40 vol %, and dischargeability was checked in the same way as in Example 1. The developer held in the developing device 5 was manufactured in the same way as in Example 2, and was evaluated as in Example 1.

Although the carrier concentration in the developer was high, homogeneity of the carrier and discharge amount stability showed virtually no change vis-à-vis Example 2. Also, there was almost no image deterioration after 100,000 sheet output thanks to the increased amount of replenished carrier.

COMPARATIVE EXAMPLE 3

A developer was manufactured as in Example 2 but using herein 68 parts of the toner b and 32 parts of the carrier f of Example 2. 1100 g of this developer were filled in the same developer container 40 as in Example 1, having an air layer taking up 35 to 40 vol %, and dischargeability was checked in the same way as in Example 1. The developer held in the developing device 5 was manufactured in the same way as in Example 2, and was evaluated as in Example 1.

The proportion of carrier contained in the developer increased, and discharge stability of the developer worsened. As a result, the amount of replenished toner could not respond to the adjustment of the image forming apparatus, the developer degraded more easily and image quality after 100,000 sheet output was worse than in Example 2 and Example 3.

EXAMPLE 4

A developer was manufactured as in Example 2 but replacing herein the toner b of Example 2 by the toner c and by using 85 parts of toner and 15 parts of carrier. 1010 g of this developer were filled in the same developer container 40 as in Example 1, having an air layer taking up 35 to 40 vol %, and dischargeability was checked in the same way as in Example 1. Developer held in the developing device 5 was manufactured as in Example 1 and was evaluated also as in Example 1, but employing herein a combination of toner and carrier identical to that of the developer held in the developer container.

Although the toner had small-size particles with a relatively narrow distribution and high circularity, discharge stability of the developer from the developer container was not inferior to that of Example 2. The image quality after 100,000 image output was better for this combination of toner and carrier than for that of Example 2.

The effect of the above-described embodiments was verified thus on the basis of Examples 1 through 4 and Comparative examples 1 through 3 explained above.

In the present invention, as described above, a developer comprising a toner and a carrier is held in a deformable developer container, the developer held in the developer container is transported together with a gas by means of a pump, and various characteristic values relating to the developer held in the developer container are optimized. As a result, the invention allows providing a developer supply device, a developer container, a developer and an image forming apparatus wherein the developer is discharged stably from the developer container, with a stable toner concentration in the developer, without damaging the developer, and in a relatively simple and small-size device having a relatively high degree of freedom as regards layout.

The present invention is not limited to the above embodiments, and it is evident that the above embodiments can accommodate suitable modifications, not hinted at in the embodiments, without departing from the technical scope of the invention. In embodying the present invention, the number, position, shape and the like of the various constituent members described above are not limited to those of the above-described embodiments, and other numbers, positions, shapes and the like are also possible.

What is claimed is:

1. A developer supply device for supplying a developer comprising a toner and a carrier to a developing unit, the developer supply device comprising:

a partially or wholly deformable developer container that holds the developer; and a pump that suctions the developer held in the developer container, together with a gas, and that discharges the developer towards the developing unit, wherein the toner comprises an additive which has a volume average particle size of 50 to 500 nm, the toner has a weight average particle size of 3 to 8 μm, and satisfies a relationship:

$$1.0 \leq D4/D1 \leq 1.4,$$

where D4 is the weight average particle size of the toner and D1 is the number average particle size of the toner, the carrier has a weight average particle size of 20 to 60 μm, the developer has a carrier concentration of 1 to 30 wt %, and an air layer occupies at least 12% of a capacity of the developer container.

2. The developer supply device as claimed in claim 1, wherein the toner has an average circularity of 0.93 to 1.00.

3. The developer supply device as claimed in claim 1, wherein the carrier has a weight average particle size of 20 to 45 μm.

4. The developer supply device as claimed in claim 1, wherein the pump is a screw pump.

5. The developer supply device as claimed in claim 1, wherein a volume of the developer container can diminish through suction by the pump.

6. The developer supply device as claimed in claim 1, wherein the developing unit comprises discharge means for discharging part of the developer held inside the developing unit.

7. A developer system comprising:

a partially or wholly deformable developer container removably installed in a developer supply device which holds a developer comprising a toner and a carrier, the developer supply device including a pump that suctions the developer held in the developer container, together with a gas, and that discharges the developer towards a developing unit, wherein, the toner comprises an additive which has a volume average particle size of 50 to 500 nm, the toner has a weight average particle size of 3 to 8 μm, and satisfies a relationship:

$$1.0 \leq D4/D1 \leq 1.4,$$

where D4 is the weight average particle size of the toner and D1 is the number average particle size of the toner, the carrier has a weight average particle size of 20 to 60 μm, the developer has a carrier concentration of 1 to 30 wt %, and an air layer occupies at least 12% of a capacity of the developer container.

8. A developer comprising:

a toner; and a carrier, the developer being held in a developer container, wherein the developer container is partially or wholly deformable, the toner includes an additive which has a volume average particle size of 50 to 500 nm, the toner has a weight average particle size of 3 to 8 μm, and satisfies a relationship:

$$1.0 \leqq D4/D1 \leqq 1.4,$$

where D4 is the weight average particle size of the toner and D1 is the number average particle size of the toner, the carrier has a weight average particle size of 20 to 60 μm, the developer has a carrier concentration of 1 to 30 wt %, and an air layer occupies at least 12% of a capacity of the developer container.

9. The developer supply device as claimed in claim 1, wherein the developer held in the developer container is premixed and the carrier concentration of the developer is constant and remains constant while being supplied to the developing unit.

10. The developer supply device as claimed in claim 9, wherein the carrier and the toner held in the developer container are in an electrically charged state.

11. The developer supply device as claimed in claim 1, wherein the developing unit comprises a discharger that discharges part of the developer held inside the developing unit.

12. The developer container as claimed in claim 7, wherein the toner has an average circularity of 0.93 to 1.00.

13. The developer container as claimed in claim 7, wherein the carrier has a weight average particle size of 20 to 45 μm.

14. The developer as claimed in claim 8, wherein the toner has an average circularity of 0.93 to 1.00.

15. The developer as claimed in claim 8, wherein the carrier has a weight average particle size of 20 to 45 μm.

* * * * *